US005676457A

United States Patent [19]

Simon

[11] Patent Number: 5,676,457

[45] Date of Patent: Oct. 14, 1997

[54] LINEAL LIGHT DISTRIBUTION

[76] Inventor: Jerome H. Simon, 17 Suffolk Rd., Chestnut Hill, Mass. 02167

[21] Appl. No.: 6,641

[22] Filed: Jan. 21, 1993

[51] Int. Cl.[6] ..... F21V 5/02

[52] U.S. Cl. ..... 362/328; 362/268; 362/308; 362/332; 362/339; 362/343

[58] Field of Search ..... 362/31, 32, 339, 362/33, 147, 148, 327, 331, 332, 343, 307–309, 328, 268; 385/31, 32, 36, 901

[56] References Cited

U.S. PATENT DOCUMENTS

| | | | |
|---|---|---|---|
| 4,012,630 | 3/1977 | Gareis | 362/32 |
| 4,151,582 | 4/1979 | Grunberger | 362/31 |
| 4,344,110 | 8/1982 | Ruediger | 362/32 |
| 4,799,137 | 1/1989 | Aho | 362/339 |
| 4,954,930 | 9/1990 | Maegawa et al. | 362/31 |
| 5,005,108 | 4/1991 | Pristash et al. | 362/31 |
| 5,064,276 | 11/1991 | Endo et al. | 362/31 |
| 5,079,675 | 1/1992 | Nakayama | 362/31 |
| 5,097,395 | 3/1992 | Aho et al. | 362/32 |
| 5,130,908 | 7/1992 | Simon | 362/147 |
| 5,233,679 | 8/1993 | Oyama | 362/32 |
| 5,365,412 | 11/1994 | Koppolu et al. | 362/32 |

*Primary Examiner*—Alan Cariaso

*Attorney, Agent, or Firm*—Jerry Cohen; Robert P. Cogan

[57] ABSTRACT

Lineal light distribution is provided from a source which may comprise a quasi-point source. The light is directed to one or more arms, each arm comprising conveyance means defining a region of light travel. Collimated light is directed into the conveyance means. Directing means in the light path direct light in respective independent paths to each of a plurality of exit means. The directing means may be discrete or distributed. The exit means each project light away from the conveyance means. The exit means are distributed at a number of locations at differing locations with respect to the source so that a lineal distribution of light from the source is provided.

19 Claims, 6 Drawing Sheets

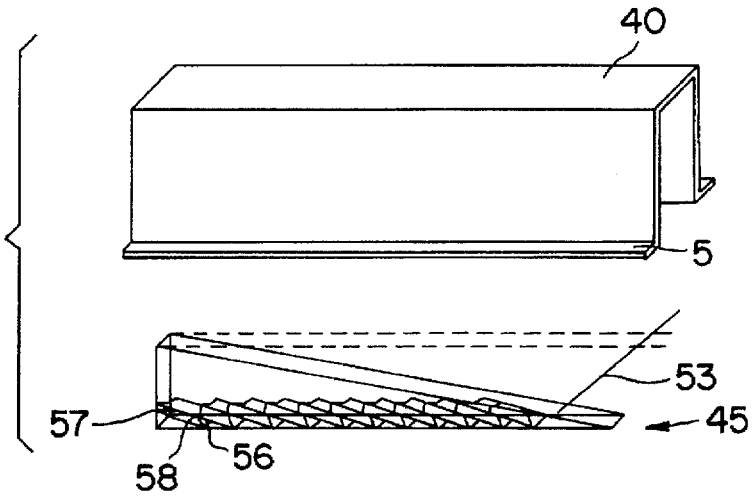
FIG. 4
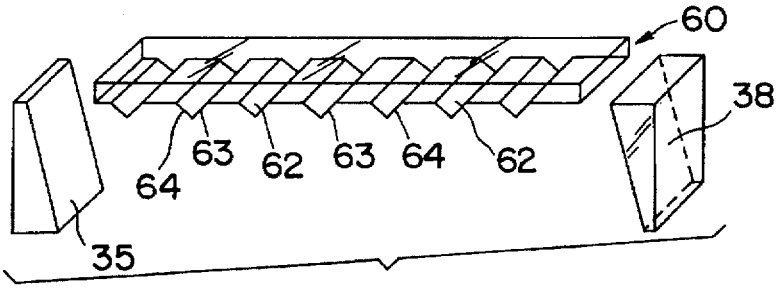
FIG. 5
FIG. 6
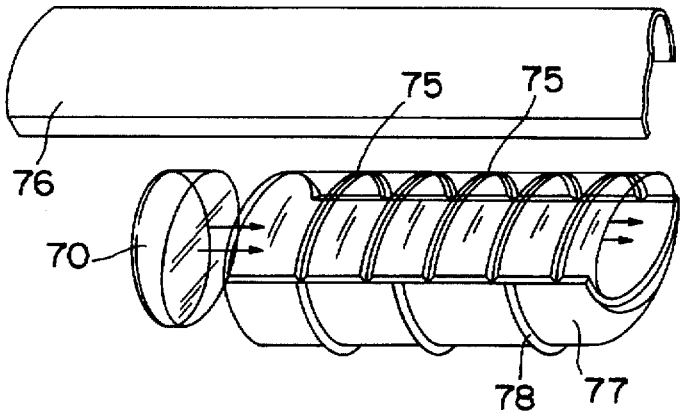
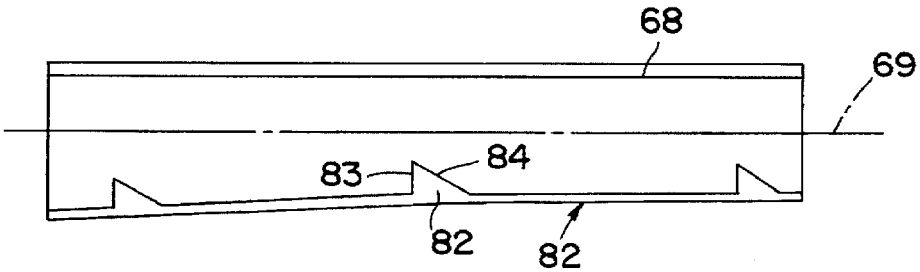
FIG. 7

LINEAL LIGHT DISTRIBUTION

BACKGROUND OF THE INVENTION

The present invention relates to systems and elements thereof for distributing light from a source.

In the present specification, the term "light" is used to describe radiant electromagnetic energy. Many applications of the present invention will utilize visible light, but this is not a necessity. Lineal distribution of light provides for even illumination of large areas. The elongated fluorescent tube provides for one form of lineal distribution along an axis. In order to project light away from the axis, it is necessary to provide a reflector adjacent to the fluorescent tube. The reflector must have dimensions many times those of the tube and must extend along substantially the whole axial length of the fluorescent tube. Flexibility in employment of such fixtures is minimal. They are better suited to providing widely distributed ambient light than to projecting a beam in a radial direction which beam has a preselected width.

Many of the structural difficulties in provision of lineally distributed light from elongated sources are overcome by the system illustrated in my U.S. Pat. No. 5,046,805, entitled Tapered Optical Waveguides for Uniform Energy (Light) Distribution Including Energy Bridging, issued Sep. 10, 1991, the disclosure of which is incorporated herein by reference. That system is very effective for distributing light over an area from an efficient centralized source. This system utilizes a tapered wedge. Along the axial dimension thereof, some light is reflected internally for further travel within the wedge and some light is transmitted to provide for lineal distribution. Due to the tapering, axial length achievable is limited by the dimensions of the wedge adjacent the source. Also, transmission of light to a remote end is at least in part dependent on the events of internal reflection and transmission at points closer to the source. In the wedge form, the structure of means which direct light into the distribution structure have a predetermined spatial and geometrical relationship to the to the exit means, i.e. the portions of the structure where light is transmitted from the structure.

It is desirable to provide the advantages of my prior system along with further advantages and flexibility in operation and construction. In accordance with the present invention, one envelope comprising a specific dimension in which light enters the distribution structure and a particular axial length and may comprise many different combinations of means for reflecting, refracting and transmitting light.

SUMMARY OF THE INVENTION

It is therefore an object of the present invention to provide a light distribution system for projecting a continuous beam away from an axis which beam has a selected axial length and a predetermined width, spread and intensity.

It is a further object of the present invention to provide a system of the type described providing a beam which is directable.

It is a general object of the present invention to provide a lineal light distribution system which has superior characteristics to prior systems in terms of flexibility in structure and functioning.

It is a more particular object of the present invention to provide a means for distribution of light from a lineal path defined by distribution means which can be tailored to meet dimensional requirements in specification lighting.

It is also an object of the present invention to provide a lineal light distribution system and elements therefore in which light directing means can be embodied independently of considerations of axial length of a distributing means.

It is another object of the present invention to provide a light distribution system of the type described in which light directing means and exit means can be designed with respect to each other to provide selected lighting results.

Briefly stated, in accordance with the present invention, lineal light distribution is provided from a source which may comprise a quasi-point source or precollimated light. The light is directed to one or more arms, each arm comprising conveyance means defining a region of light travel. Collimated light is directed into the conveyance means. Directing means in the light path direct light in respective independent paths to each of a plurality of exit means. The directing means may be discrete or distributed. Collimation means be be part of the source means or combined with directing means or both. The exit means each project light away from the conveyance means.

BRIEF DESCRIPTION OF THE DRAWINGS

The means by which the foregoing objects and features of invention are achieved are pointed out with particularity in the claims forming the concluding portion of the specification. The invention, both as to its organization and manner of operation, may be further understood by reference to the following description taken in connection with the following drawings.

Of the drawings:

FIGS. 4 through 7 are each an illustration of a light distribution arm constructed in accordance with the present invention;

DESCRIPTION OF THE PREFERRED EMBODIMENTS

Figure 1:
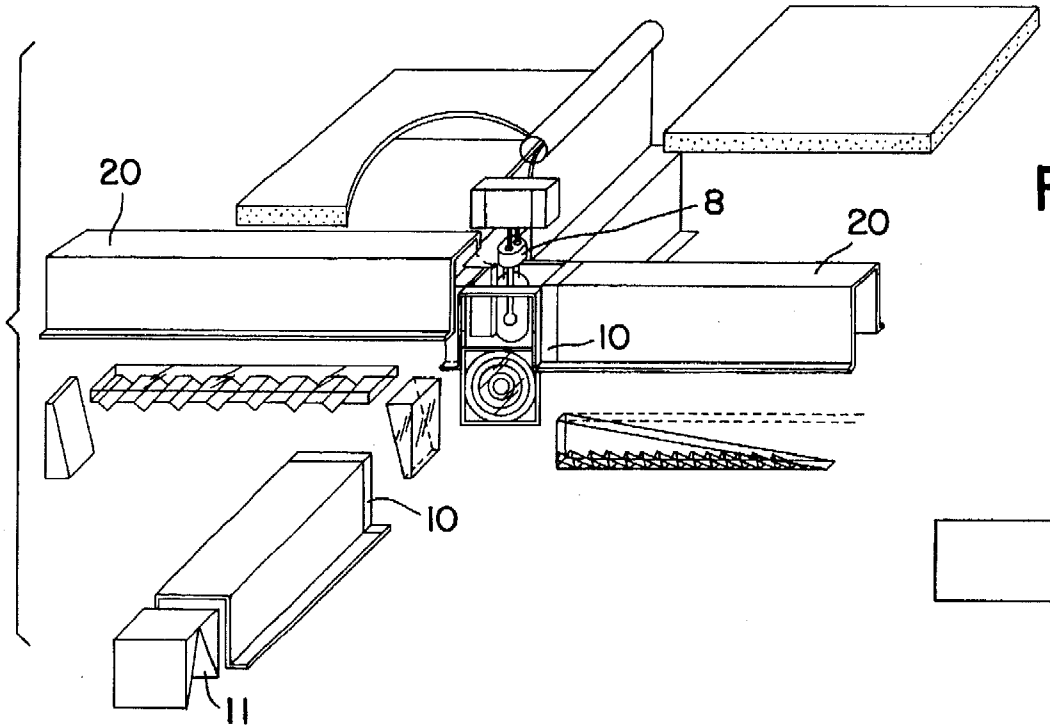
FIG. 1 is an axonometric view of a system constructed in accordance with the present invention.
Figure 2:
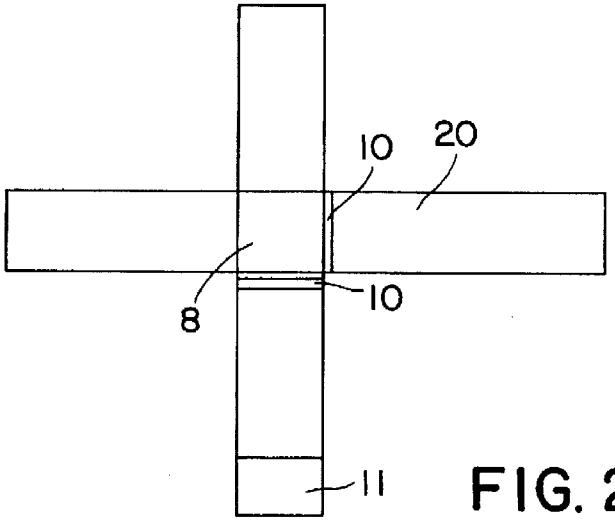
FIG. 2 is a plan view of the apparatus of FIG. 1.

FIG. 1 is an axonometric view of a system constructed in accordance with the present invention, and FIG. 2 is a plan view of the apparatus of FIG. 1. In the various figures, the same reference numerals are used to denote the same components. Directions such as up or down are used in the present description to agree with the disposition of the components in the figures. However, the directions are arbitrary, and simply used to describe relative spatial relationships. A lineal distribution system 1 is provided to distribute light from a source chamber 8. The significance of light being provided from a chamber is that is will require lineal distribution. Light from the source chamber 8 may be effectively a point source or may be collimated.

The source chamber 8 will direct light through a source coupling means 10. It is not essential that the source coupling means 10 be embodied with discrete walls. The source coupling means 10 is a region defining the location from which light to be distributed enters the lineal distribution means. The source coupling means 10 may simply comprise an interface plane or may comprise a conduit of fixed or variable length.

The light from the source coupling means 10 in many embodiments will be uncollimated and provided from a quasi point source. In the context of the present invention, a quasi point source refers, for example, to a lamp. A preferred form of lamp is a high intensity metal halide are lamp. Such a lamp is not a point source, but approximates a point source in that light is provided from a highly centralized origin. A halogen filament or halide are will have some length and width. A lamp is not a true point source. Hence the terminology quasi point source is used. The source coupling means 10 need not include a lamp. It could include a beam of collimated light projected into the chamber 10 and refracted therefrom. Sources could included a projected beam from a remote are or filament source, or could include solar energy.

In many embodiments, only one source coupling means 10 will be provided. However, a plurality of source chambers at opposite ends of various light paths may be provided. In the embodiment of FIGS. 1 and 2, a second source chamber 11 is provided displaced from the source chamber 1. The source chambers 10 and 11 may supply light either at alternate times or at the same time. For example, the source coupling means 10 may supply light from an electrical source, and the source chamber 11 may supply solar light. The system 1 may include one arm 20 or a plurality of arms 20 each for providing a light path extending from one or both of the source chambers 10 and 11. In the embodiment of FIGS. 1 and 2, the source coupling means 11 is a telescoping chamber so that a variable dimension may be selected for the overall size of the system 1.

In the present embodiment, four orthogonal arms 20 are provided, but other numbers of arms 20 at other relative angular relationships may be provided. As described above, in selected embodiments the arm 20 may have an adjustable length to fill different spaces. However, light is not directed out of the source coupling means 10. As further described below, a separate adjustability may be provided in the overall axial extent over which light is provided. Flexibility in design is also provided in that a wide range of lineal dimension of the arm 20 may be provided for a given dimension of size of the entrance aperture to the arm 20 from the source coupling means 10 even when a fixed length arm 20 is being designed.

Figure 3:
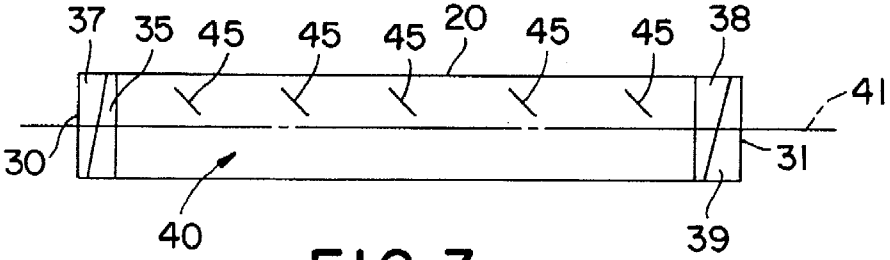
FIG. 3 is an optical schematic diagram illustrating operation of lineal light distribution means in accordance with the present invention.

FIG. 3 is an optical schematic diagram illustrating significant features of an arm 20. An interface 30 comprises the source coupling means 10. Directing means 35 direct collimated light from the source coupling means 10 into conveyance means 40. A collimator 37 may be placed between the directing means 35 and the interface 30. The collimator 37 may be eliminated if collimated light is supplied from the source chamber 8. Alternatively, the collimator 37 may be formed integrally with the directing means 35. The conveyance means 40 need not necessarily have discrete walls. The conveyance means 40 defines a region of travel of light in a degree of freedom defined by an axis 41 from the source coupling means 10. Light will be projected away from the axis 41. Light is directed from the arm 20 by exit means 45. The exit means 45 will commonly be distributed throughout the lineal dimension of the arm 20. In some embodiments, a second directing means 38 and collimator 39 may be located adjacent an interface 31 at an opposite end of the conveyance means 40. The interface 31 may interface with the source chamber 11 or other similar means. The distribution of light from the different positions along the axial dimension of the conveyance means 40 will be substantially even. Of course, unevenness in point to point measurements can be resolved. However, the human eye will tend to integrate variation of up to thirty percent. Also, selected degrees of unevenness could be provided by design.

FIGS. 4 through 7 are illustrations of various forms of arm 20 constructed in accordance with the present invention. This range of illustrations is intended to teach those skilled in the art how to apply the teachings of the claims below to provide many different forms of a system constructed in accordance with the present invention. Many variations will suggest themselves.

In the embodiment of FIG. 4, which is an exploded axonometric view, the conveyance means 40 comprises a T-bar structural trough having flanges 50 to which ceiling panels (not shown) can be supported. Directing means 35 comprises a continuous light distributing reflector 53 inclined to be in vertical registration with the interface 30 the the source coupling means 10 and to be in horizontal registration with the lineal dimension of the conveyance means 40. Exit means 45 comprises prism means 56 arranged to be continuously distributed. The prism means 56 each comprise a refracting portion 57 and a substantially planar portion 58. The planar portions are overlaid prism. In one embodiment the planar portions are slidable with respect to each other over a range which will leave exposed a refracting portion 57 of each prism means 56. In this embodiment, the exit means can be telescoped to provide variable length between refractive portions of successive prism means 56. This provides for a selectable axial extent of the exit means 45. Consequently, the conveyance means 40 may have a selectable length. This selectability increases the ability of a system according to the present invention to fill an architectural space.

In the embodiment of FIG. 5, a conveyance means 40 has directing means 35 and 38 at opposite ends thereof, respectively adjacent a first interface 30 to the source coupling means 10 and a second interface 31 to the source chamber 11. Each directing means 35 and 38 comprises a prismatic refractor. The exit means 45 comprises a reflector 60 having a horizontal surface 61 from which regularly spaced reflective V-shaped surfaces 62 project downwardly. Each leg of the V may be at a 45 degree angle to the surface 61. In the illustration of FIG. 5, the legs to the left of each V-shaped surface 62 comprise a reflector 63 having light directed thereto by the directing means 35. The legs on the right of each V-shaped surface 62 each constitute a reflector 64 receiving light from the directing means 38. Each reflector 63 directs light downwardly which has been directed from the source coupling means 10 and distributed lineally. Each reflector 64 directs light downwardly which has been directed from the source chamber 11 and distributed lineally.

In the embodiments of FIGS. 6 and 7, each arm 20 comprises a right circular cylinder 68 having an axis 69 rather than a rectangular trough. Directing means comprises a prismatic wedge 70 which may be circular and have a diameter d in arbitrary units. The conveyance means 40 comprises a semicircular shell 72 having a width of d and a height of d/2. The shell 72 is of sufficient thickness to have V-shaped circumferential grooves 74 which are uniformly axially spaced and serve as directing means 45. Legs 75 of the V-shaped groove 74 face the prismatic wedge 70. The shell 72 may be formed of a clear plastic material such as Lucite or glass. The grooves 74 may be silvered. The shell 72 may be supported to a structural trough member 76. The conveyance means 40 may further include, if desired, a further semicircular shell 77, shown in exploded form, to mate with the semicircular shell 72. The semicircular shell 77 is clear for transmitted light from the grooves 74. Light baffle means 78 are provided at preselected axial distances along the shell 77. Each baffle means 78 comprises an arcuate, radially extending member to permit radial transmission but to reduce glare as viewed from non-radial directions.

In the embodiment of FIG. 7, a plurality of axially displaced prismatic exit means 82 each subtend a predetermined are on the inner diameter of conveyance means 80. Each exit means 82 has a radially disposed surface 83 and an intersecting surface 84 at an angle of approximately 45 degrees to the radial direction. Directing means 35 (not shown in this Figure) direct light to each of the exit means 82. Light enters the exit means 82 and is reflected by each surface 84. Each radially disposed surface 83 comprises baffling means. A viewer facing the cylinder 68 at an angle other than that at which light is leaving the surfaces 84 will have glare blocked by the surfaces 83. In order to further increase selectivity in the ability to direct light away from the system 1, the cylinder 68 may be made rotatable about the axis 69.

Figure 8:
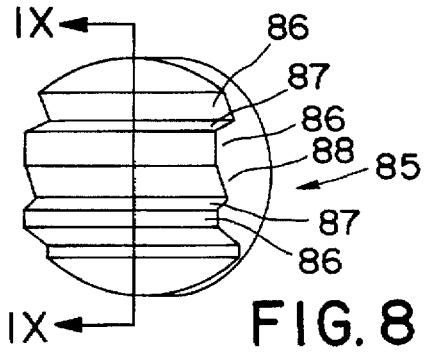
FIGS. 8 through 14 are views each illustrating further forms of light directing means.
Figure 9:
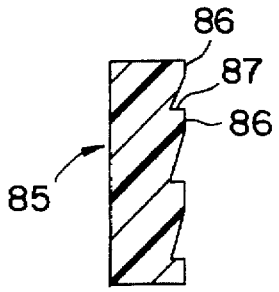
Figure 10:
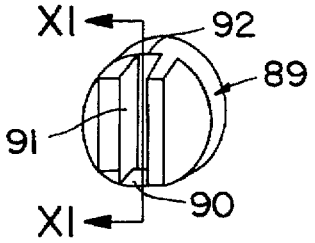
Figure 11:
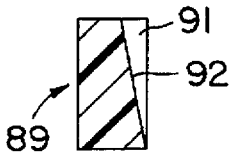

FIGS. 8 through 14 each illustrate further forms of directing means 35. The directing means 35 need not be of a regular geometry or formed of continuous contours as is in the embodiments of FIGS. 5, 6 and 7. The directing means serve the purpose of spreading light along the axial length of the arm 20 so that exit means 45 can direct lineally distributed light from the system 1. FIGS. 8 and 9 are respectively an axonometric view of a dividing prism and a cross sectional view taken along lines IX—IX of FIG. 8. FIGS. 10 and 11 are respectively an axonometric view of a dividing prism and a cross sectional view taken along lines XI—XI of FIG. 9.

Directing means 35 of FIGS. 8 and 9 comprises a dividing prism 85 having a transverse face 86, which may be defined as a cylinder having grooves each defined by one axial surface 87 and a second planar surface 88 at an angle of between zero and 20 degrees to the face 86. Each surface 88 meets a surface 87 to define a plurality of parallel wedge prisms. Surfaces 88 act as windows which allow for transmission to further directing means.

The directing means 35 of FIGS. 10 and 11 comprises a dividing prism 89 with a plurality of grooves 90 each parallel with a vertical diameter, with axial sidewalls 91 on opposite sides of surfaces 92 which are planar and may each be at an angle of zero to 20 degrees to the axis. The prisms 85 and 89 each spread light form a source coupling means 10 throughout conveyance means 40. The larger the angle, the more sharply the beam will be deflected with respect to the axial direction.

Figure 12:
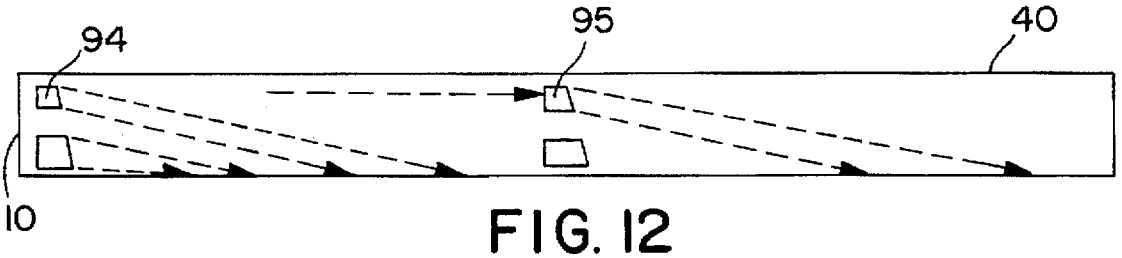
Figure 13:
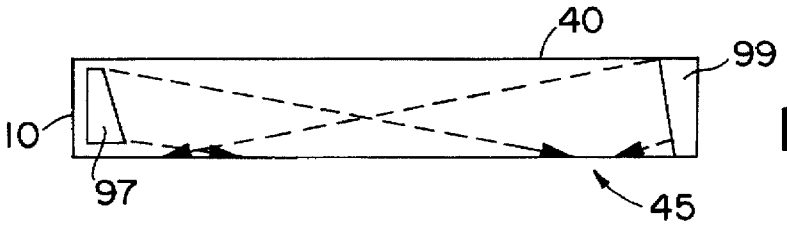
Figure 14:
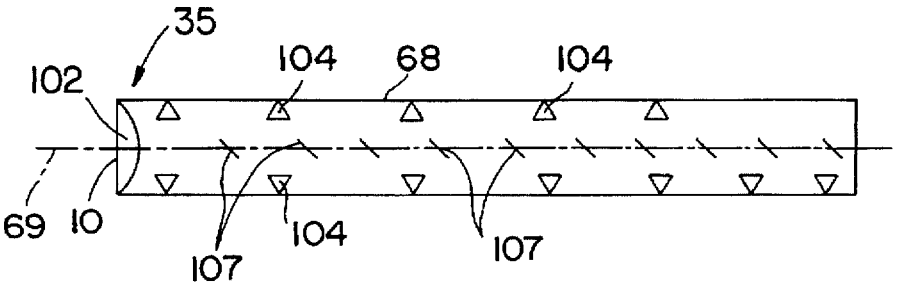

FIGS. 12, 13 and 14 are each mechanical schematic illustrations of embodiments in which the directing means 35 are distributed rather than discrete. In the embodiment of FIG. 12, the directing means comprises a chain of axially displaced prisms 94 and 95. The prism 94 distributes about half the light from the source coupling means 10 over a first axial portion of the conveyance means 40 and about half to the second prism 95. The prism 95 distributes light along the remainder of the axial extent of the conveyance means 40. Here again, substantially even distribution of light in the axial direction is provided for.

In the embodiment of FIG. 13, directing means 35 comprises a refracting prism 97 at a first axial end of the conveyance means 40 adjacent the source coupling means 10. At an opposite axial end of the conveyance means 40 is a canted reflective surface 99. In this embodiment, light directed from the prism 97 is directed to both exit means 45 and to the surface 99. The surface 99 directs light in a direction having an axial component in the direction back toward the source coupling means 10 and having a radial component such that the light is directed to further exit means 45. The spreading of light in the axial dimension of the conveyance means 40 need not be unidirectional.

In the embodiment of FIG. 14, the directing means 35 comprises a lens 102 directing light to each of a plurality of prisms 104 adjacent the periphery of a cylinder 68. The prisms 104 may be of differing angular dimensions to provide for variation in deflection as described above with respect to FIG. 10. Exit means 45 comprise a plurality of centrally disposed reflective surfaces 107 each intersected by the axis 69. Light is directed by the directing means 35 to regions at the radial center of the cylinder 68 and then directed out of the cylinder 68.

Figure 15:
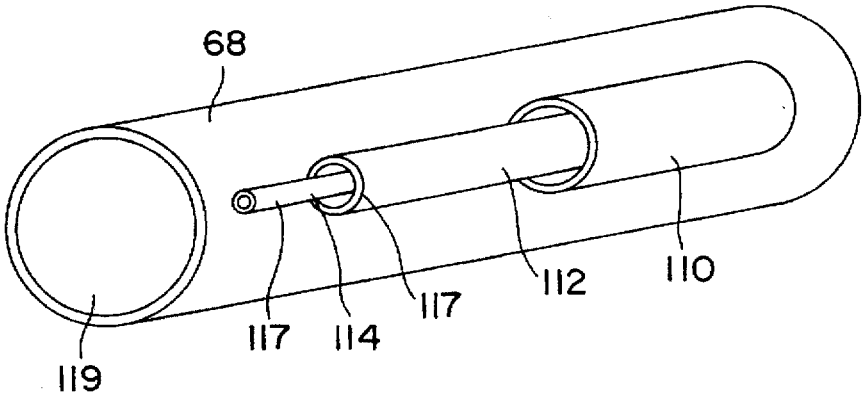
FIGS. 15 through 18 are illustrations of further embodiments demonstrating further applications of design concepts to embody the present invention.
Figure 16:
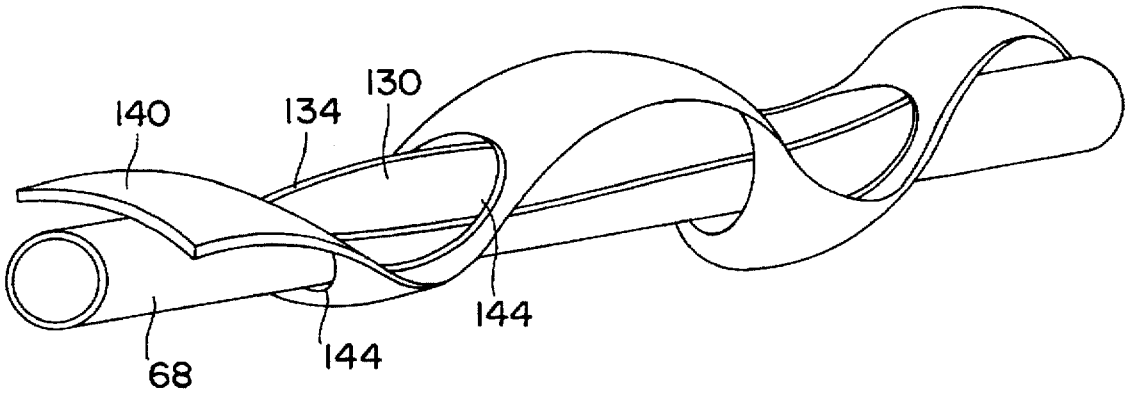

FIGS. 15 and 16 are axonometric illustrations of arms 20 with other forms of distribution and/or means not comprising items such as prisms and reflectors. In the embodiment of FIG. 15, the conveyance means 40 is a cylinder 68. Preferably, light from the source chamber 8 is not totally collimated in this embodiment, and some preselected degree of spreading with respect to the axial direction takes place. The directing means 35 are defined by a plurality of surfaces which contain the light and which have staggered surface terminations. Consequently, light is permitted to spread at staggered axial locations, and the directing function is achieved. For example, coaxial tubes 110, 112 and 114 are mounted within the cylinder 68. The tubes 110, 112 and 114 are of decreasing diameter and increasing axial length. Each tube has a wall 117. Directed light exits from areas between adjacent walls 117. The exit means 45 may, for example, comprise a lens surface diffusing film 119 on the lower half of the cylinder 68. In one form, the upper half of the tube 68 may comprise reflecting means, and the lower half of the tube 68 may comprise lens means.

In the embodiment of FIG. 16, which is also an axonometric view, the conveyance 40 comprises the tube 68. However the tube 68 is modified to further comprise exit means 45. A large radius cut 130 is made in the tube 68 such the the axial dimension of the cut is a majority of the axial length of the cylinder 68, and the depth of the cut 130 may exceed the diameter of the cylinder 68. This cut 130 creates aperture 134 extending the thickness of the cylinder 68. Exit means 45 comprises a sinuous ribbon 140 having elliptical apertures 144 therein for receiving the cylinder 68 so that the ribbon 140 is symmetrically mounted about the cylinder 68. In this embodiment, the light traveling from the source coupling means 10 exits from the surface 134 and is directed from the cylinder 68 by the ribbon 140. In this embodiment, the source in the source chamber 8 is substantially collimated. However, there is sufficient dispersion such that light traveling a small angles to the axis 69 of the cylinder 68 leaves the aperture 34 and strikes the surface 134 to be reflected for distribution.

Figure 17:
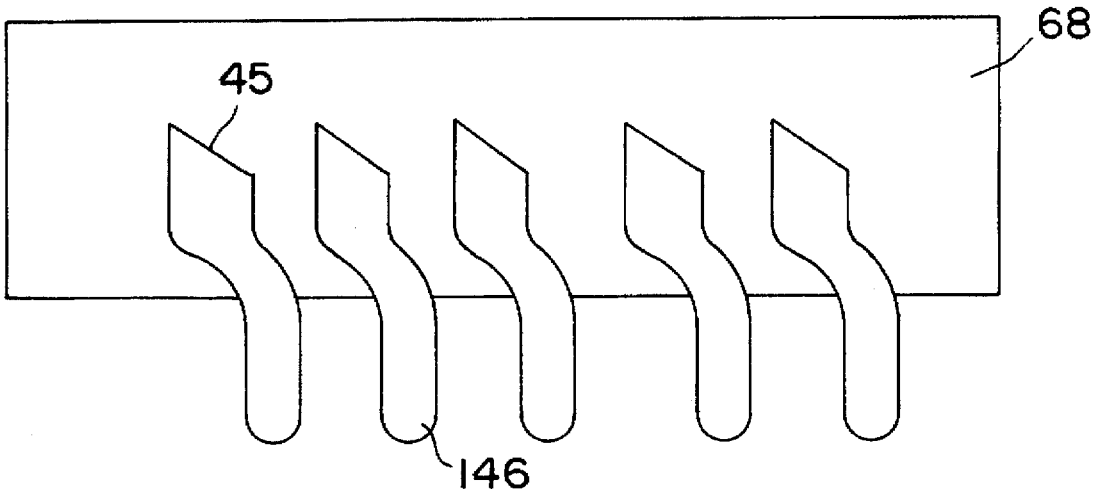

In the embodiment of FIG. 17, the exit means 45 comprises axially spaced and centrally located surfaces 142 which receive light from directing means 35. The surfaces 142 comprise ends of respective optical fibers 144 each having an exit aperture 146. The fibers 144 extend in a radial degree of freedom. The exit apertures 146 may be arranged in a preselected pattern, and may feed a further fiber optic array (not shown).

Figure 18:
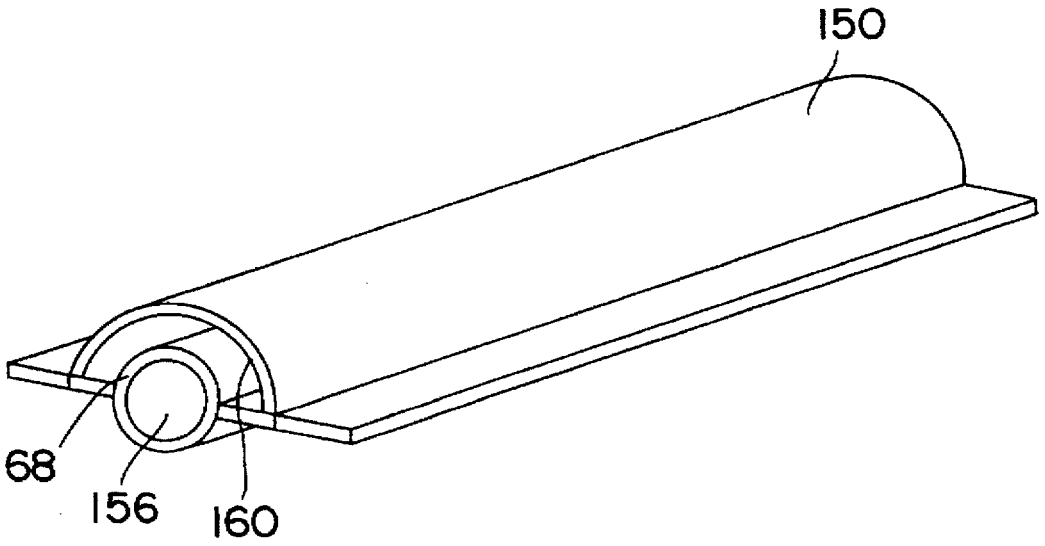

FIG. 18 discloses an embodiment in which a semicircular cylinder 150 is coaxially mounted with respect to the the upper half of the cylinder 68. Directing means 35 may be according to a number of above-described embodiments. The exit means 45 may comprise a lens surfacing film 156. The upper surface of the cylinder 68 may be clear so that any light escaping upwardly is reflected by the surface of the reflector 160. Other sources may provide light to the surface 160. In this manner, indirect lighting may be combined with the direct, lineally distributed light.

Figure 19:
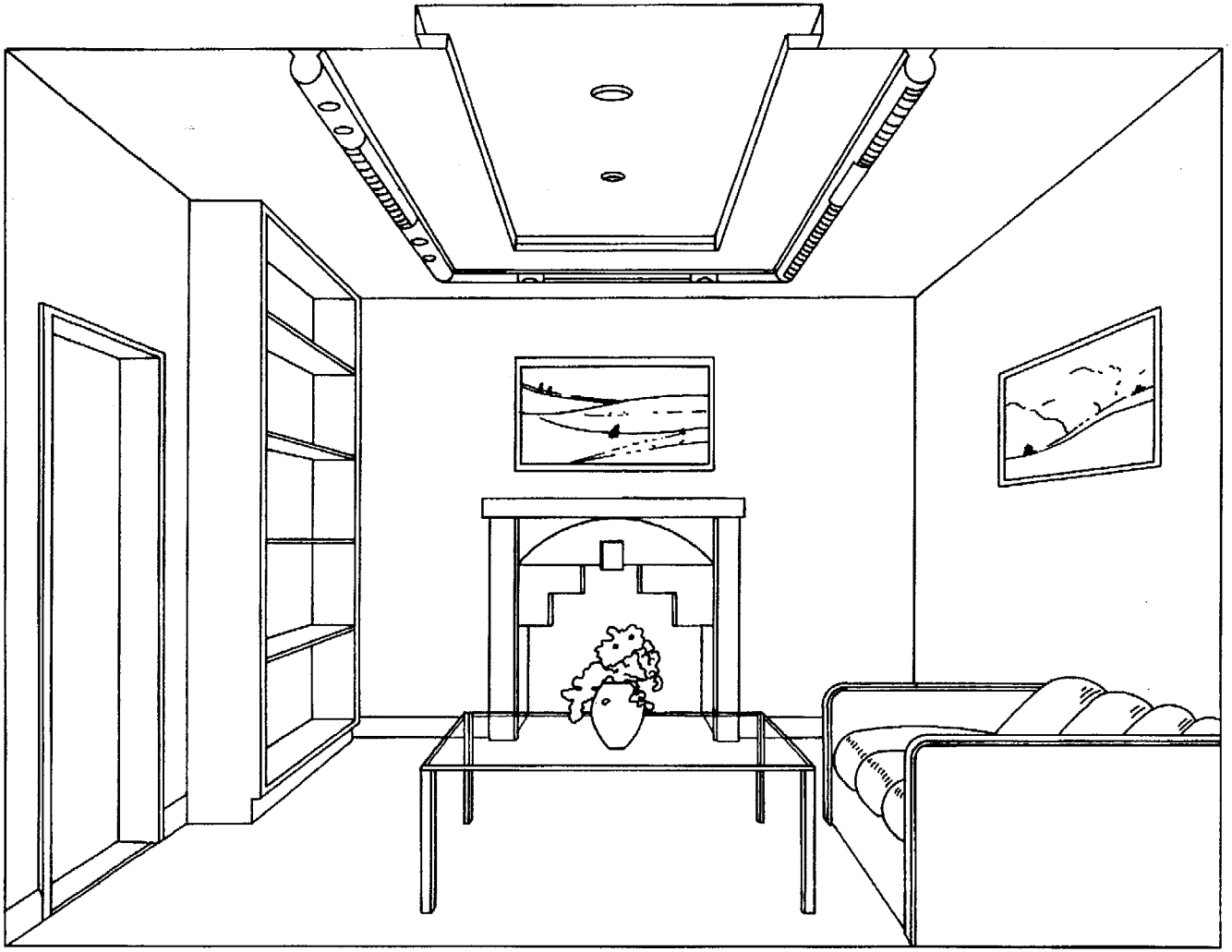
FIG. 19 is a perspective illustration of a room incorporating lineal light distribution according to the present invention.

FIG. 19 is a perspective illustration of a room incorporating lineal light distribution according to the present invention. Arms 20-1 and 20-3 are each perpendicularly disposed to opposite ends of a central arm 20-2. The source chamber 10 is located intermediate the arms 20-1 and 20-2, while the source chamber 11 is located intermediate the arms 20-2 and 20-3. Various forms of conveyance means may comprise each of the arms 20-1, 20-2 and 20-3. They may be mounted in a ceiling 180 which also includes conventional downlights 186.

The above specification will enable those skilled in the art to construct many forms of lineal light distribution systems and subsystems thereof, whether explicitly illustrated above or achievable based on the above teachings. Many forms of subsystems can be combined within a system 1 to provide for lineal light distribution in accordance with the present invention.

What is claimed as new and desired to be secured by Letters Patent of the United States is:

1. A lineal light distribution system comprising source chamber means for providing a collimated beam of parallel rays directed parallel to an axis, conveyance means disposed on the axis defining a region of travel for light beams, a series of exit means axially displaced along said conveyance means, and direction means for changing the directing of the axially projected collimated beam such that each said exit means intercepts a portion of the collimated beam, said exit means being disposed to direct light away from said conveyance means.

2. A system according to claim 1 wherein said exit means comprises a plurality of prism means located adjacent said source chamber means.

3. A system according to claim 2 wherein said exit means comprises a plurality of overlaid prism means to expose a refracting area of each said prism means and to provide for one planar surface of one said prism means engaging a mating surface of a next said prism means.

4. A system according to claim 3 wherein said plurality of prism means are slidably disposed with respect to each other such that the exit means can be telescoped to provide variable length between refractive portions of successive prism members, whereby said conveyance means may have a selectable length.

5. A system according to claim 1 wherein said exit means comprises prism members projecting from an axially extending surface of said conveyance means.

6. A system according to claim 5 wherein each said prism members comprises an angled surface for directing light from said conveyance means and a radial surface acting as light baffling means.

7. A system according to claim 1 wherein said exit means comprises a plurality of reflectors.

8. A system according to claim 7 wherein said reflectors are located along an axis of said conveyance means.

9. A system according to claim 7 wherein said conveyance means comprises a cylindrical envelope and said reflectors are distributed on a surface thereof.

10. A system according to claim 1 wherein said exit means comprises a diffusing film.

11. A system according to claim 1 wherein said directing means comprises prism means.

12. A system according to claim 11 wherein said prism means comprises beam segmenting means.

13. A system according to claim 1 wherein said directing means comprises means for segmenting light from said source chamber in a plurality of paths.

14. A system according to claim 13 wherein said directing means comprises coaxially mounted concentric tubes of increasing axial length and decreasing diameter.

15. A system according to claim 1 wherein said directing means comprises an aperture formed in a tube axially extending from said source chamber and having a cut formed therein in the radial dimension and wherein said exit means comprises a sinuous reflector surface through which said tube extends.

16. A system according to claim 1 further comprising source chamber coupling means disposed between said source chamber and said conveyance means and having an adjustable length.

17. A system according to claim 1 further comprising collimating means positioned between said source chamber means and said directing means.

18. A system according to claim 1 wherein said directing means further comprise a reflector at an end of said conveyance means remote from source chamber means.

19. A lineal light distribution system comprising a plurality of arms, each and being constructed according with claim 1, said arms including the source chamber, each said arm being disposed in a different axial direction.

* * * * *